United States Patent [19]

Sailer

[11] Patent Number: 4,767,281

[45] Date of Patent: Aug. 30, 1988

[54] CENTRIFUGAL PUMP SYSTEM WITH INLET RESERVOIR

[75] Inventor: Thomas Sailer, Amherst, Ohio

[73] Assignee: Lear Siegler, Inc., Elyria, Ohio

[21] Appl. No.: 58,237

[22] Filed: Jun. 4, 1987

[51] Int. Cl.[4] ..... F04D 9/06

[52] U.S. Cl. ..... 417/83; 417/89; 415/168

[58] Field of Search ..... 417/80, 81, 83, 84, 417/89; 415/53 R, 143, 168; 123/514, 516, 518

[56] References Cited

U.S. PATENT DOCUMENTS

| | | | |
|---|---|---|---|
| 2,853,014 | 9/1958 | Carpenter | 417/83 |
| 2,987,002 | 6/1961 | Schipper | 417/83 X |
| 3,063,377 | 11/1962 | Stanley et al. | 417/83 |
| 3,387,644 | 6/1968 | Heinecke et al. | 417/79 |
| 3,394,655 | 7/1968 | Brown | 417/89 X |
| 3,895,885 | 7/1975 | Liberg | 417/54 |
| 4,037,991 | 7/1977 | Taylor | 417/80 |
| 4,142,839 | 3/1979 | Davis et al. | 417/89 |
| 4,704,070 | 11/1987 | Iseman | 417/80 |

FOREIGN PATENT DOCUMENTS

| | | | |
|---|---|---|---|
| 577276 | 6/1959 | Canada | 417/83 |
| 84-04364 | 11/1984 | PCT Int'l Appl. | 417/80 |

*Primary Examiner*—Robert E. Garrett
*Assistant Examiner*—Joseph M. Pitko
*Attorney, Agent, or Firm*—Renner, Otto, Boisselle & Sklar

[57] ABSTRACT

Pump system includes a centrifugal pump having an inlet reservoir connected to the upstream end thereof for initially receiving the vapor/liquid mixture entering the system to allow air or vapor to separate from the liquid. Below the liquid level in the reservoir is a mixing tube which provides the only liquid flow path to the centrifugal pump. Also within the reservoir below the liquid level is a main ejector pump which injects liquid into the mixing tube. The injected liquid induces liquid flow from the reservoir into the mixing tube for flow to the centrifugal pump. Also, one or more vapor scavenge ejectors may be provided within the reservoir to induce air or vapor from selected collection areas within the reservoir and propel the air or vapor into the mixing tube intermediate its length where the air or vapor is thoroughly mixed with the liquid contained therein at an intermediate pressure higher than the reservoir pressure before entering the centrifugal pump.

24 Claims, 2 Drawing Sheets

CENTRIFUGAL PUMP SYSTEM WITH INLET RESERVOIR

BACKGROUND OF THE INVENTION

This invention relates generally, as indicated, to a centrifugal pump system with inlet reservoir, which is specifically designed for pumping vapor/liquid mixtures such as aircraft fuel and the like wherein the volume ratio of vapor to liquid of the mixture is relatively high and the vapor is not mixed with the liquid when it enters the system. Instead, the vapor enters as large air or vapor bubbles separate from the liquid. Such a system is particularly suited for applications where the supply tank for the vapor/liquid mixtures is substantially below the pump thus requiring the pump to lift the mixture from the tank.

Heretofore, conventional practice has been to use a positive displacement pump such as a vane pump, NASH liquid ring pump, or a spur gear type pump to pump a vapor/liquid mixture containing large air or vapor bubbles.

Ordinarily, it would be preferable to use a centrifugal pump because of the several advantages a centrifugal pump has over a positive displacement pump. For example, the flow discharge from a centrifugal pump can be varied from shut-off to values exceeding design flow while maintaining constant speed, whereas a positive displacement pump requires bypass flow circuits in applications where pump speed varies independently of liquid flow requirements. Also, a centrifugal pump is more durable and more resistant to contaminants in the pumped liquid, and is generally less costly than a positive displacement pump. However, a conventional centrifugal pump will not operate under conditions where there are large bubbles present in the liquid and the liquid supply tank is below the pump since the bubbles will fill the impeller and produce vapor lock, causing the impeller to lose prime, whereby the pump will no longer be able to lift the liquid.

A centrifugal pump can effectively be used to pump a liquid having a high vapor/liquid ratio as long as the vapor is finely divided within the liquid and the pump is charged with an ejector pump in the manner shown, for example, in U.S. Pat. No. 4,142,839, assigned to the same assignee as the present application, which is incorporated herein by reference. However, if the vapor/liquid mixture contains large amounts of air or vapor separate from the liquid, the mixture is extremely difficult if not impossible to pump using such a centrifugal pump with ejector.

SUMMARY OF THE INVENTION

With the foregoing in mind, it is a principal object of this invention to provide a centrifugal pump system which is capable of pumping liquids having large air or vapor bubbles separate from the liquid entering the system inlet.

Another object is to provide such a pump system for pumping liquids having large air or vapor bubbles separate from the liquid entering the system inlet which will operate as a suction lift system with the liquid tank below the pump under conditions of low net positive pressure suction head where the inlet pressure is close to the true vapor pressure of the liquid.

These and other objects of the present invention may be achieved by providing a centrifugal pump system including an inlet reservoir which initially receives the vapor/liquid mixture entering the system to allow the air or vapor to separate from the liquid. Within the inlet reservoir below the normal liquid level is a main ejector pump in series and immediately upstream of a centrifugal impeller. The main ejector pump induces the liquid from below the liquid level within the reservoir into a mixing tube while boosting the pressure of the mixing liquid before being directed to the impeller. At the same time, the pressurized flow from the main ejector pump functions to break up the bubbles within the liquid in the mixing tube. Motive flow for the ejector pump is supplied from the centrifugal impeller discharge. Also, one or more vapor scavenge ejectors may be incorporated within the inlet reservoir to induce air or vapor from selected collection areas within the reservoir and propel the air or vapor into the mixing tube where the air or vapor is thoroughly mixed with the liquid within the mixing tube at an intermediate pressure higher than the reservoir pressure before entering the impeller.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
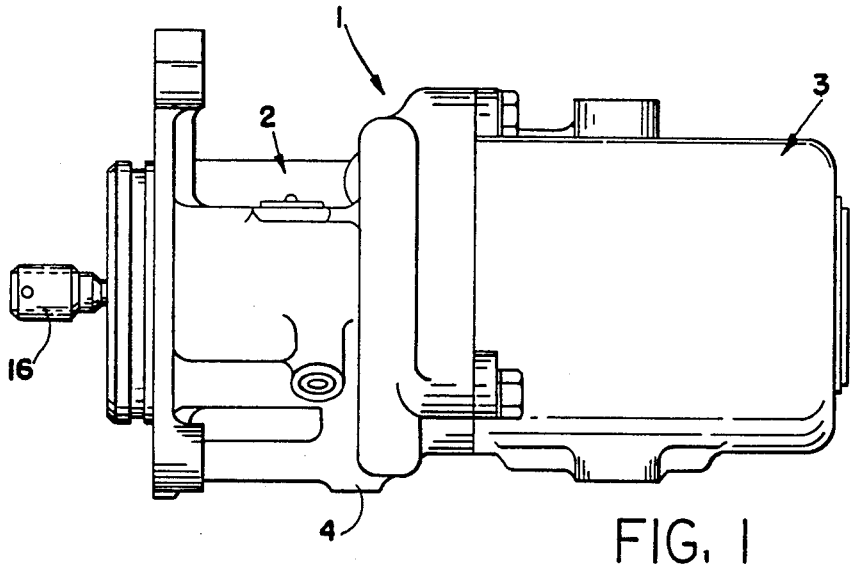
FIG. 1 is a side elevation view of a preferred form of pump system in accordance with this invention.
Figure 2:
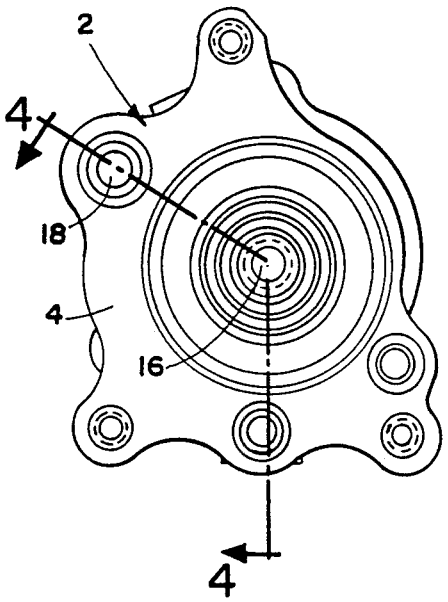
FIG. 2 is an end elevation view of the pump system of FIG. 1 as seen from the left end thereof.
Figure 3:
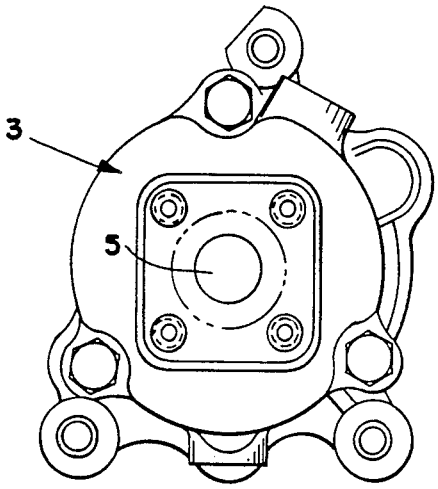
FIG. 3 is an end elevation view of the pump system of FIG. 1 as seen from the right end thereof.
Figure 4:
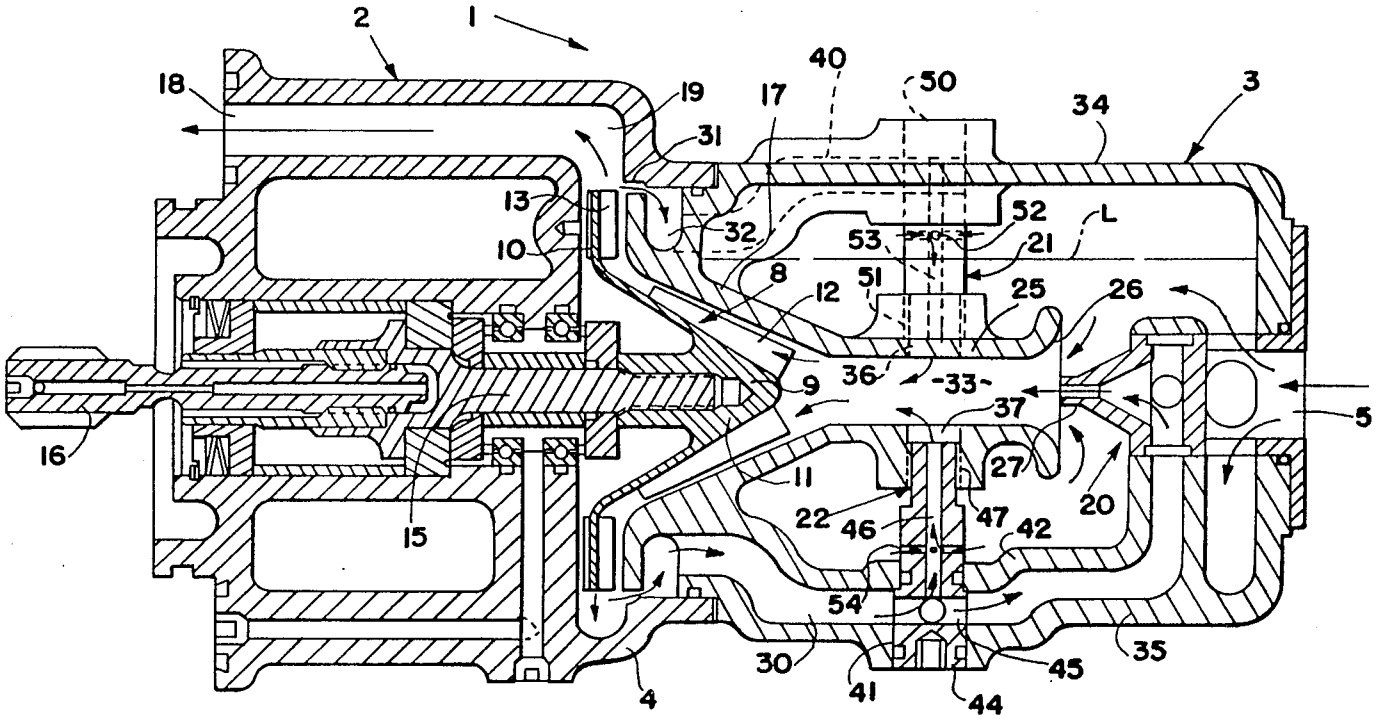
FIG. 4 is an enlarged longitudinal section through the pump system of FIG. 2, taken generally along the plane of the line 4—4 thereof.

Referring now in detail to the drawings, there is shown a preferred form of pump system 1 in accordance with this invention including a centrifugal pump 2 having a liquid inlet reservoir 3 suitably connected to the upstream end of the centrifugal pump housing 4. At the upstreammost end of the reservoir 3 is a main inlet 5 to which a liquid line such as a fuel line, not shown, may be connected to provide for flow, for example, of fuel from the fuel tanks of an aircraft into the inlet reservoir where the inlet air or vapor within the liquid will separate and rise above the normal liquid level L within the tank as schematically shown in FIG. 4.

The centrifugal pump 2 may generally be of the type disclosed in the aforementioned U.S. Pat. No. 4,142,839, including a centrifugal impeller 8 which, as clearly shown in FIG. 4, desirably includes an inducer section 9 and a centrifugal impeller section 10 on a common disc-hub 11 combination. The inducer section 9 including the inducer blades 12 taper outwardly relative to the axis of the pump, whereas the centrifugal impeller section 10 including the centrifugal blades 13 desirably extend substantially radially outwardly from the radial outermost end of the inducer section.

The centrifugal impeller 8 is the primary pumping element of the pump system 1, and is suitably mounted on a shaft 15 driven as by means of a motor or other suitable power supply (not shown) connected to the shaft by a drive coupling 16 exteriorly of the pump housing 4. Surrounding the impeller 8 in closely spaced relation thereto is a shroud 17 into which the liquid is drawn from beneath the liquid level L within the reservoir 3 during rotation of the impeller and forced radially outwardly to increase the fluid pressure due to centrifugal force before being discharged through the main pump outlet 18. The velocity of the liquid leaving the impeller is greater than that entering. Such velocity is reduced somewhat as the liquid enters an annular discharge diffuser 19 surrounding the centrifugal impeller section 10. The velocity head of the liquid within the diffuser 19 is partly converted to pressure which is used to supply the required discharge flow from the pump as well as the motive flow for both a main ejector pump 20 and one or more vapor scavenge ejectors 21, 22 within the reservoir 3, as described hereafter.

As clearly shown in FIG. 4, the main ejector pump 20 is mounted within the inlet reservoir 3 below the normal liquid level L within the reservoir in series and immediately upstream of a mixing tube 25 which is desirably formed as an integral extension of the shroud 17 surrounding the centrifugal impeller 8. Mixing tube 25 may be of substantially uniform diameter over its length. However, the entrance 26 thereto is desirably radially outwardly tapered as shown to facilitate inducement of the liquid within the reservoir into the mixing tube.

Main ejector pump 20 includes a discharge nozzle 27 at the inlet 26 to the mixing tube 25 in coaxial alignment therewith for injecting liquid under pressure into the tube. The high velocity jet of liquid which is discharged by the jet nozzle 27 into the mixing tube 25 induces liquid flow from the reservoir into the mixing tube and functions to break up the bubbles within the liquid while boosting the pressure of the liquid before being directed into the impeller 8.

The liquid motive flow for the main ejector 20 is supplied from the impeller 8 discharge through a motive flow passage 30 in the inlet reservoir 3. Fluid communication between the impeller discharge and motive flow passage 30 desirably occurs immediately adjacent the outer diameter of the impeller 8 through an annular slot 31 and annular groove 32 leading to such motive flow passage. Preferably, the annular slot 31 extends at right angles to the normal directional flow of liquid radially outwardly of the impeller 8 as shown in FIG. 4. The main ejector pump 20 induces liquid from the reservoir 3 into the mixing tube 25 and boosts the pressure of the liquid by transferring the momentum of the high velocity motive flow discharged from the nozzle 27 into the lower velocity induced liquid to supply the impeller 8 with liquid at a higher pressure than at the main inlet 5 pressure.

One or more vapor scavenge ejectors may also be provided within the reservoir 3 for inducing air or vapor from collection areas within the reservoir and propelling the air or vapor into the throat portion 33 of the mixing tube 25 where it is thoroughly mixed with the liquid within the mixing tube at an intermediate pressure higher than the reservoir pressure before entering the impeller 8. In the preferred embodiment disclosed herein, two such vapor scavenge ejectors 21, 22 are provided, the ejector 21 being located adjacent the reservoir top 34, and the ejector 22 being located adjacent the reservoir bottom 35. Both vapor scavenge ejectors 21, 22, like the main ejector pump 20, may be supplied with high velocity motive flow from the impeller 8. The motive flow for the vapor scavenge ejectors passes through the vapor scavenge ejectors and is propelled through radial passages 36, 37 in the mixing tube 25 into the main ejector mixing throat 33.

The motive flow passage 40 for the upper vapor scavenge ejector 21 may communicate with the annular groove 32 leading to the main motive flow passage 30, whereas the lower vapor scavenge ejector 22 may communicate directly with the main motive flow passage 30, as by inserting the lower vapor scavenge ejector 22 through an opening 41 in the reservoir bottom 35 and surrounding wall 42 of the main motive flow passage 30. The lower vapor scavenge ejector housing 44 has radial passages 45 therethrough in alignment with the main motive flow passage 30 thus permitting unobstructed flow through the main motive flow passage. At the same time, a small portion of the motive flow through the main motive flow passage 30 will pass through a central passage 46 in the lower vapor scavenge ejector 22 in communication with the radial passage 37 in the mixing tube 25. The inner end of the lower vapor scavenge ejector housing 44 may be threaded for threaded engagement in a counterbore 47 in the mixing tube in alignment with passage 37.

The upper vapor scavenge ejector housing 50 may similarly have its radial inner end threaded for threaded engagement in a counterbore 51 in the mixing tube 25 in alignment with the radial passage 36 therein for passage of motive flow through the upper vapor scavenge ejector 21 into the mixing tube. Air or vapor bubbles present in the inlet reservoir 3 separate from the liquid and rise to the top where they are induced into the upper vapor scavenge ejector 21 through radial ports 52 therein above the normal liquid level L in the reservoir and propelled into the mixing tube throat 33 as schematically shown in FIG. 4.

Likewise, the lower vapor scavenge ejector 22 includes radial ports 54 providing communication between the longitudinal passage 46 in the ejector 22 and the interior of the reservoir adjacent the reservoir bottom 36 but above the main motive flow passage wall 42 for inducing into such longitudinal passage air or vapor bubbles present in sloshing liquid and in liquid in other than positive "G" conditions common in aircraft pumping applications and the like where vapor would be present near the bottom of the inlet reservoir. The vapor scavenge ejectors 21, 22 meter the air or vapor bubbles into the mixing tube 25 at a rate high enough to prevent excess vapor from collecting in the inlet reservoir 3 and yet low enough not to exceed the limit for air ingestion into the impeller 8. Consequently, excess air or vapor cannot collect in the inlet reservoir 3, and the impeller 8 is continuously supplied with either all liquid or a homogeneous mixture of liquid and entrapped air or vapor bubbles at a pressure slightly above the main inlet 5 pressure.

From the foregoing it will now be apparent that the pump system of the present invention functions because of the interaction between the inlet reservoir, main ejector pump, vapor scavenge ejectors, and impeller to pump a liquid having a high vapor/liquid ratio containing large air or vapor bubbles. The inlet reservoir ensures an uninterrupted supply of liquid to the mixing tube and allows air or vapor entering the reservoir to rise to the top near the inlet ports to the upper vapor scavenge ejector. The vapor scavenge ejectors meter the air or vapor into the throat of the mixing tube at a rate high enough to prevent excess vapor from collecting in the inlet reservoir without exceeding the limit for air ingestion into the impeller so that the impeller is continuously supplied with either all liquid or a homogeneous mixture of liquid and entrapped air and/or vapor bubbles.

Such a pump system converts inlet vapor and liquid flow which occurs in large discrete volumes and integrates such flow into a homogeneous mixture with a vapor/liquid ratio equal to or less than that at the main inlet to the reservoir and supplies same to the impeller at a pressure slightly above that at the main inlet pressure. The impeller then raises the pressure of the liquid and discharges the required flow from the pump while recirculating the required motive flow for both the main ejector pump and vapor scavenge ejectors.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A pump system comprising pump means, liquid reservoir means upstream of said pump means providing for the separation of air or vapor from liquid entering said reservoir means through a main inlet to said reservoir means, ejector pump means within said reservoir means below the normal liquid level in said reservoir means during operation of said pump system for inducing liquid flow from said reservoir means into said pump means, mixing tube means within said reservoir means between said ejector pump means and pump means, said mixing tube means including an entrance end and a throat portion upstream of said entrance end, and scavenge ejector means in said reservoir means for inducing air or vapor within said reservoir means directly into said throat portion of said mixing tube means for mixing of such air or vapor with the liquid in said mixing tube means at an intermediate pressure higher than the pressure in said reservoir means before entering said pump means.

2. The pump system of claim 1 wherein said mixing tube means is below the normal liquid level in said reservoir means during operation of said pump system, whereby the liquid which is injected into said mixing tube means by said ejector pump means induces liquid flow from said reservoir means to said pump means through said mixing tube means.

3. The pump system of claim 2 wherein said ejector pump means injects liquid into said entrance end of said mixing tube means in communication with the liquid in said reservoir means, whereby the injected liquid induces liquid flow from said reservoir means into said entrance end of said mixing tube means for flow to said pump means.

4. The pump system of claim 3 wherein said ejector pump means includes a discharge nozzle at said entrance end of said mixing tube means through which liquid is injected into said mixing tube means, and means are provided for producing a liquid motive flow from said pump means to said discharge nozzle.

5. The pump system of claim 4 wherein said pump means comprises a centrifugal pump, said centrifugal pump including a centrifugal impeller, said impeller being surrounded by a shroud defining an inlet to said impeller which communicates with the interior of said reservoir means through said mixing tube means.

6. The pump system of claim 5 wherein said mixing tube means forms an integral extension of said shroud.

7. The pump system of claim 1 wherein said scavenge ejector means includes means for inducing air or vapor adjacent the top of said reservoir means into said mixing tube means.

8. The pump system of claim 1 wherein said scavenge ejector means includes means for inducing air or vapor adjacent the bottom of said reservoir means into said mixing tube means.

9. The pump system of claim 1 wherein there are a plurality of said scavenge ejector means in said reservoir means for inducing air or vapor from different locations within said reservoir means into said mixing tube means.

10. The pump system of claim 1 further comprising means for providing a liquid motive flow to said scavenge ejector means.

11. The pump system of claim 1 further comprising a first motive flow passage from said pump means to said ejector pump means for providing a liquid motive flow to said ejector pump means, and a second motive flow passage from said first motive flow passage to said scavenge ejector means for providing a liquid motive flow to said scavenge ejector means.

12. The pump system of claim 11 wherein said scavenge ejector means includes a housing extending from said first motive flow passage to said mixing tube means intermediate the length of said mixing tube means, and said second motive flow passage comprises a central passage in said housing providing communication between said first motive flow passage and the interior of said mixing tube means intermediate its length.

13. The pump system of claim 12 wherein said housing extends through said first motive flow passage and has radial passages therethrough providing unobstructed flow through said first motive flow passage and reduced flow from said first motive flow passage to said central passage in said housing.

14. The pump system of claim 12 further comprising radial ports in said housing providing communication between said central passage and an air or vapor collection area within said reservoir means.

15. A pump system comprising pump means having an upstream end, a reservoir connected to said upstream end, said reservoir having a main inlet for liquid being pumped, said reservoir providing for the separation of air or vapor from such liquid as such liquid enters said reservoir through said main inlet, a mixing tube in said reservoir below the normal liquid level in said reservoir during operation of said pump system, said mixing tube providing the only liquid flow path between the interior of said reservoir and said pump means, said mixing tube havig one end in communication with the interior of said reservoir below such normal liquid level and the other end connected to an inlet to said pump means, a main ejector pump within said reservoir below such normal liquid level for injecting liquid into said one end of said mixing tube, whereby the injected liquid induces liquid flow from the interior of said reservoir into said mixing tube for flow to said inlet to said pump means, and scavenge ejector means within said reservoir for inducing air or vapor within said reservoir directly into a throat portion of said mixing tube intermediate the ends of said mixing tube for mixing such air or vapor with the liquid in said mixing tube at an intermediate pressure higher than the reservoir pressure before entering said pump means.

16. The pump system of claim 15 wherein said ejector pump includes a discharge nozzle adjacent said one end of said mixing tube for injecting liquid into said mixing tube, and means are provided for producing a liquid motive flow from said pump means to said discharge nozzle.

17. The pump system of claim 16 wherein said pump means comprises a centrifugal pump, said centrifugal pump including a centrifugal impeller surrounded by a shroud defining said centrifugal pump inlet, said mixing tube forming an integral extension of said shroud.

18. The pump system of claim 15 wherein there are a plurality of said scavenge ejector means within said reservoir for inducing air or vapor from different locations within said reservoir into said mixing tube.

19. The pump system of claim 15 further comprising a first motive flow passage from said pump means to said main ejector pump for providing a liquid motive flow to said main ejector pump, and a second motive flow passage from said pump means to said scavenge ejector means for providing a liquid motive flow to said scavenge ejector means.

20. A pump system comprising pump means, liquid reservoir means upstream of said pump means providing for the separation of air or vapor from liquid entering said reservoir means, ejector pump means for inducing liquid flow from said reservoir means into said pump means, mixing tube means for receiving the liquid flow from said reservoir means and ejector pump means and directing same to said pump means, and a plurality of scavenge ejector means in said reservoir means for inducing air or vapor from different locations within said reservoir means for mixing of such air or vapor with the liquid flow through said mixing tube means.

21. The pump system of claim 20 wherein one of said scavenge ejector means includes means for inducing air or vapor from adjacent the top of said reservoir means, and another of said scavenge ejector means includes means for inducing air or vapor from adjacent the bottom of said reservoir means.

22. The pump system of claim 20 further comprising means for providing a liquid motive flow to said scavenge ejector means for inducing air or vapor from within said reservoir means directly into said mixing tube means at an intermediate pressure higher than the pressure in said reservoir means.

23. A pump system comprising pump means, liquid reservoir means upstream of said pump means providing for the separation of air or vapor from liquid entering said reservoir means, ejector pump means for inducing liquid flow from said reservoir means into said pump means, mixing tube means for receiving the liquid flow from said reservoir means and ejector pump means and directing same to said pump means, and scavenge ejector means in said reservoir means for inducing air or vapor from within said reservoir means directly into said mixing tube means for mixing of such air or vapor with the liquid flow through said mixing tube means, and means for providing a liquid motive flow to said scavenge ejector means for inducing such air or vapor from within sad reservoir means directly into said mixing tube means at an intermediate pressure higher than the pressure in said reservoir means.

24. The pump system of claim 23 wherein said ejector pump means injects liquid into one end of said mixing tube means in communication with the liquid in said reservoir means, whereby the injected liquid induces liquid flow from said reservoir means into said mixing tube means, and said scavenge ejector means induces air or vapor from within said reservoir means directly into a throat portion of said mixing tube means intermediate the ends of said mixing tube means.

* * * * *